US006152863A

United States Patent [19]

Nelson et al.

[11] Patent Number: 6,152,863

[45] Date of Patent: Nov. 28, 2000

[54] MARTIAL ARTS PHYSICAL INTERACTION DEVICE AND METHOD

[75] Inventors: Mark Nelson, 128 Kennewyck Cir., Slingerlands, N.Y. 12159; Raymond H. Puffer, Jr., Watervliet, N.Y.; Thomas Bonkenburg, York, Pa.; Brad Hunting, Mead, Colo.

[73] Assignee: Mark Nelson

[21] Appl. No.: 09/232,480

[22] Filed: Jan. 15, 1999

[51] Int. Cl.[7] ..... A63B 69/34

[52] U.S. Cl. ..... 482/83; 482/84

[58] Field of Search ..... 482/1–9, 82–90, 482/900–902

[56] References Cited

U.S. PATENT DOCUMENTS

| | | |
|---|---|---|
| 835,796 | 11/1906 | Lindsley . |
| 3,250,533 | 5/1966 | Nicholson, II . |
| 3,804,406 | 4/1974 | Viscione . |
| 3,888,481 | 6/1975 | Adams, Jr. et al. . |
| 4,401,303 | 8/1983 | Anderson et al. . |
| 4,765,609 | 8/1988 | Wilson et al. . |
| 4,819,934 | 4/1989 | Wilson et al. . |
| 4,989,862 | 2/1991 | Curtis . |
| 5,100,138 | 3/1992 | Wilde . |
| 5,256,069 | 10/1993 | Snowden, Jr. et al. . |
| 5,503,606 | 4/1996 | Stephens . |
| 5,509,875 | 4/1996 | Moretti . |
| 5,582,561 | 12/1996 | Gonzalez . |
| 5,647,747 | 7/1997 | Macri et al. . |
| 5,665,035 | 9/1997 | Tumminia . |
| 5,700,230 | 12/1997 | Cardona . |
| 5,735,775 | 4/1998 | Miasserian . |
| 5,921,896 | 7/1999 | Boland ..... 482/84 |

*Primary Examiner*—Glenn E. Richman
*Attorney, Agent, or Firm*—Heslin & Rothenberg, P.C.

[57] ABSTRACT

A physical interaction device includes a controller and one or more arms, such as a first arm and a second arm. The first arm is movably connected with a first support. The first arm includes a first flexible portion sized to physically interact with a first limb portion of a user of the device. The second arm is movably connected with a second support. The second arm includes a second flexible portion sized to physically interact with the first limb portion of the user and/or a second limb portion of the user. The controller is linkable with the first arm and the second arm. The controller is configured to selectively cause a first movement of the first flexible portion of the first arm. The controller is configured to selectively cause a second movement of the second flexible portion of the second arm. The first movement of the first flexible portion of the first arm serves to contact the first flexible portion of the first arm with the user to physically imitate a first human strike toward the user. The second movement of the second flexible portion of the second arm serves to contact the second flexible portion of the second arm with the user to physically imitate a second human strike toward the user.

19 Claims, 3 Drawing Sheets

MARTIAL ARTS PHYSICAL INTERACTION DEVICE AND METHOD

TECHNICAL FIELD

This invention relates, generally, to sports and fitness training systems and, more particularly, to interactive training systems for martial arts enthusiasts.

BACKGROUND ART

Various devices have been designed which facilitate athletic training. A number of systems have been configured especially for receiving physical blows from a user. Certain devices have attempted to produce physical interaction between the user and the devices with some degree of animation.

In martial arts training, for example, a user may often seek to obtain a simulated sparring partner when an actual partner is not available, or when a partner with a sufficient level of skill for that user is not available. Namely, in order to improve the user's skills, the user may typically seek to train with an opponent of generally equal or greater skill than the user.

Some systems have been developed which offer some movement with a certain degree of independence from the user. However, it remains desirable to improve the realism of interaction between the training device and the user. For instance, it would be desirable to provide an improved feel and force interplay between the device and the user, for activities such as receiving punches, blocking strikes, and delivering blows. In addition, it remains desirable to improve configurability and adjustability of the training device.

Thus, a need exists for a physical interaction device in which physical movement of the device resembles likely or possible acts by a potential opponent. A need also exists for the device to aid and/or develop timing and/or reaction skills. In addition, a need exists for the device to train and/or improve hand and eye coordination. Another need exists for the device to promote general physical condition of a user, such as by providing a cardiovascular workout. A further need exists for the device to be formed with physical characteristics which upon impact or engagement with the user provide a feel resembling hand-to-hand combat. Yet another need exists for such a training device allowing user practice of blocking techniques or footwork, such as for the martial arts. A still further need exists for such a training device which may be adjusted for various physical attributes of the user or desired type of training. Another need exists for specific programmability of the training device.

SUMMARY OF THE INVENTION

Pursuant to the present invention, shortcomings of the existing art are overcome and additional advantages are provided through the provision of a martial arts physical interaction device.

In one aspect of the invention, a physical interaction device includes an arm and a controller. The arm is movably connected with a support. The arm includes an elongate flexible portion sized to physically interact with a limb portion of a user of the device. The controller is linkable with the arm. The controller is configured to selectively cause a longitudinal movement of the flexible portion. The movement serves to extend the flexible portion from the support and contact the flexible portion with the user to physically imitate a human strike toward the user.

In a combination with the support, the support can be vertically, horizontally, and/or obliquely adjustably connected with a base.

The flexible portion can be formed to allow the user to employ the limb portion to execute a block and/or deflection of the movement of the flexible portion of the arm. The controller can be linked with the arm. The controller can allow random selection and/or user preselection of frequency, timing, direction, duration, speed, force, and/or sequencing of a plurality of movements of the flexible portion of the arm.

In a combination with the support, the support can be connected with a base. A cushion can be connected with the base. The cushion can be formed to receive a physical strike from the user.

The cushion can be vertically and/or horizontally adjustably connected with the base. The cushion can include a region sized comparably to a torso. A location of the arm relative to the region of the cushion can serve to imitate a relation between a human arm and a torso corresponding to the human arm. A part of the arm and/or the cushion can be formed to resemble a human physique portion.

An electrical, hydraulic, pneumatic, and/or mechanical link can allow the controller to be linked with the arm.

The arm can comprise a first arm, and the support can comprise a first support. The elongate flexible portion of the first arm can comprise a first flexible portion. The longitudinal movement can comprise a first movement. A second arm can be movably connected with a second support, and can include a second flexible portion sized to physically interact with the user. The controller can be linked with the second arm, and can be configured to selectively cause a second movement of the second flexible portion of the second arm. The second movement can serve to extend the second flexible portion of the second arm from the second support and contact the second flexible portion of the second arm with the user.

A location of the first arm relative to the second arm can serve to imitate a relation between a pair of human arms. A third arm can be movably connected with a third support. The third arm can include a third flexible portion sized to physically interact with the user. The controller can be linked with the third arm. The controller can be configured to selectively cause a third movement of the third flexible portion of the third arm. A relation between the first movement of the first flexible portion of the first arm and the third movement of the third flexible portion of the third arm can serve to imitate strikes emanating from one side of a human. The strikes can be directed toward the user. The second movement of the second flexible portion of the second arm can serve to imitate a strike emanating from another side of the human.

In another aspect of the invention, a physical interaction device includes a first arm, a second arm, and a controller. The first arm is movably connected with a first support. The first arm includes a first flexible portion sized to physically interact with a first limb portion of a user of the device. The second arm is movably connected with a second support. The second arm includes a second flexible portion sized to physically interact with the first limb portion of the user and/or a second limb portion of the user. The controller is linkable with the first arm and the second arm. The controller is configured to selectively cause a first movement of the first flexible portion of the first arm. The controller is configured to selectively cause a second movement of the second flexible portion of the second arm. The first movement of the first flexible portion of the first arm serves to contact the first flexible portion of the first arm with the user to physically imitate a first human strike toward the user. The second movement of the second flexible portion of the second arm serves to contact the second flexible portion of the second arm with the user to physically imitate a second human strike toward the user.

The first support can be connected with a base. The second support can be connected with the base. A cushion can be connected with the base. The cushion can be located between the first support and the second support.

The invention further contemplates a physical interaction method. An elongate flexible portion of an arm is located apart from a user. The arm is movably connected with a support. The flexible portion of the arm is sized to physically interact with a limb portion of the user. The flexible portion of the arm is extended longitudinally from the support to contact the user and physically imitate a human strike toward the user.

The flexible portion of the arm can be retracted from the user to physically imitate a human recoil from the user.

The elongate flexible portion can comprise a first flexible portion. A second flexible portion of a second arm can be extended from a second support to contact the user and physically imitate a second strike toward the user.

A relation between th e extending of the first flexible portion of the first arm and the extending of the second flexible portion of the second arm can serve to imitate a relation between strikes emanating from a pair of human arms.

A plurality of movements of the flexible portion of the arm can be executed as directed by a random selection and/or a preselection of frequency, timing, direction, duration, speed, force, and/or sequencing of the plurality of movements of the flexible portion of the arm.

Thus, the present invention advantageously provides physically realistic interaction between a user and an arm formed to simulate a human opponent. Furthermore, the invention allows random selection and/or preselection of movements of the arm (e.g., to allow specific or challenging training for the user). Also, the invention provides enhanced realism of interaction between the user and multiple strikes from a simulated opponent, such as by providing strikes resembling blows from opposite arms of an opponent. In addition, a cushion may absorb blows from the user, and advantageously be positioned to resemble a torso and/or a head of a human opponent, and may advantageously be coordinated with location or movement of an arm. Furthermore, movement of the arm and/or location of the arm and/or cushion may be adjusted to suit the user. Moreover, a plurality of movements of one or more arms may be random and/or preselected for particular training of the user (e.g., with a desired mix or difficulty of strikes, blocks, and/or blows).

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be readily understood from the following detailed description of preferred embodiments taken in conjunction with the accompanying drawings in which:

BEST MODE FOR CARRYING OUT THE INVENTION

In accordance with the principles of the present invention, a martial arts physical interaction device is provided.

Figure 1:
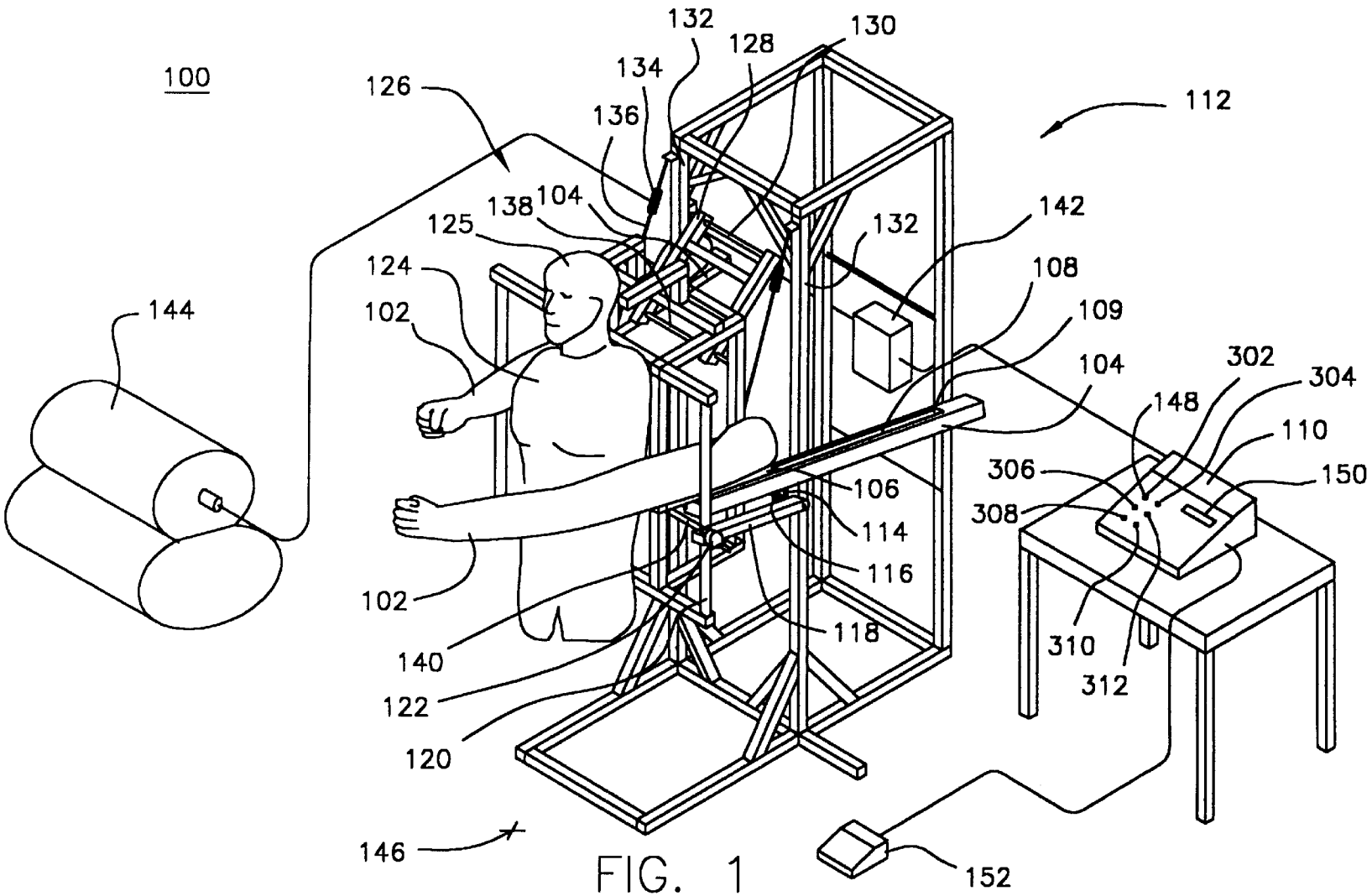
FIG. 1 is a partial, perspective view of one example of a physical interaction device, illustrating one example of cooperative formation and location of flexible arms and a cushion.

One example of a martial arts physical interaction device incorporating and using the novel features of the present invention is depicted in FIG. 1 and described in detail herein.

Referring to FIG. 1, physical interaction device 100 may include a plurality of instances of arm 102 and corresponding instances of support 104. For example, the support 102 may have flexibility, and may be mounted on holder 106 received by slot 108 of the support 104. In one example, controller 110 may direct movement of the holder 106 along the slot 108. In one aspect, instances of end member (e.g., actuator and/or shock absorber) 109 may be positioned on the support 104, such as at the ends of the slot 108, for motivating and stopping the holder 106 and the arm 102 in longitudinal movement with respect to the support 104. In particular, the arm 102 may be controlled to exhibit piston-like movement with respect to the support 104. Further description of the arm 102 and the support 104 is presented herein.

Still referring to FIG. 1, support 104 may be adjustably connected to base 112. In one example, the base 112 may resemble or comprise one or more (e.g., interconnected) frames. In one aspect, the support 104 may be supported with rod 114 slidingly received by sleeve 116 attached to the support 104, where the rod 114 may be mounted in bar 118 connected to member 120 by (e.g., user adjustable) instance of locking unit 122. The instance of the locking unit 122 may allow restriction of the bar 118 against certain vertical movement. Furthermore, another instance (not shown) of the locking unit 122 may be disposed to restrict horizontal movement of the bar 118 and the rod 114, as will be understood by those skilled in the art. In another aspect, the connection of the support 104 to the base 112 may allow a user to select a desired orientation for the support 104 and the arm 102, as described herein.

Referring again to FIG. 1, cushion 124 may be connected to base 112. For instance, the cushion 124 may be braced by and/or hung or mounted on sub-frame 126 of the base 112. In one example, the sub-frame 126 may receive vertical and horizontal support from "H" bar 128 mounted on rod 130 connected to instances of vertical member 132 of the base 112, and instances of spring 134 and cable 136 attached to the instances of the vertical members 132. For example, the "H" bar 128 may be connected to rod 138 of the sub-frame 126, and the instances of the cable 136 may be fastened to cross-bar 140 of the sub-frame 126. In one aspect, rod 114 may comprise or be connected with a portion of the sub-frame 126.

So, further referring to FIG. 1, a user or another person (e.g., an adult supervising a youth) may adjust a number of physical orientations and/or positioning of physical interaction device 100. For example, the user may unlock instances of locking unit 122 disposed between sub-frame 126 and other portions of base 112, for allowing re-positioning of the sub-frame 126. In one example, the sub-frame 126 may swing on rod 130 with support from instances of spring 134, in order to locate cushion 124 at a height appropriate or suitable for the user. That is, once a desired positioning of the cushion 124 is obtained, various instances of the locking unit 122 disposed in the base 112, may be locked or tightened, as will be understood by those skilled in the art.

Furthermore, referring to FIG. 1, a user may advantageously make adjustments to location, direction, and/or orientation of instances of arm 102. In one example, the user may position cushion 124 to imitate a torso of an opponent, and align instances of the arm 102 to imitate certain strikes from the opponent, as described herein.

Again referring to FIG. 1, in one example, controller 110 may employ pneumatics and/or hydraulics to motivate longitudinal movement of an instance of arm 102 relative to a corresponding instance of support 104. For example, the controller 110 may be coupled to intermediary unit 142, which may be coupled to a pressure source such as (e.g., air) compressor 144 for delivering selected pressure (e.g., impulses) to one or more selected instances of holder 106 corresponding to an instance of the arm 102. In an additional aspect, the intermediary unit 142 may be coupled with an electrical source (not shown) for any desired application or use of electricity in physical interaction device 100, as will be understood by those skilled in the art.

For illustrative purposes, a description of exemplary operation of controller 110, intermediary unit 142, and compressor 144 is now presented with reference to FIG. 1. In one example, a user may provide a number of directions, selections, commands, and/or instructions to the controller 110, which may communicate the same to the intermediary unit 142. Further, the intermediary unit 142 may follow or respond to the directions from the controller 110, by (e.g., appropriately) opening and/or closing a number of regulators or valves (not shown) within the intermediary unit 142. The valves (not shown) may be in fluid communication with tubes or hoses (not shown) located between the intermediary unit 142 and corresponding instances of support 104, for applying or stopping (e.g., air) pressure from the compressor 144 to, for example, corresponding cavities such as (e.g., air) cylinders (not shown) within instances of support 104, to cause (e.g., longitudinal, piston-like) movement of instances of holder 106 and instances of arm 102, as will be appreciated by those skilled in the art. So, in one embodiment, the user may preselect a certain instance of the arm 102 to be extended and/or retracted along a respective instance of the support 104. In particular, the opening and/or closing of the valves (not shown) in the intermediary unit 142 in response to user directions delivered from the controller 110, may cause air pressure charging and/or evacuation with respect to the cylinders (not shown) within instances of the support 104, for movement of the instances of holder 106 to carry the respective instances of the arm 102 under pneumatic power derived from the compressor 144. Additional detail concerning exemplary user operation of the controller 110 is presented further below.

In one example, referring to FIG. 1, a user may intend to stand approximately at and/or over location 146, that is, in front or forward of cushion 124 and instances of arm 102 connected with base 12. Furthermore, before or between intervals of training with physical interaction device 100, the user may make adjustments to height and/or transverse and/or longitudinal location of the cushion 124 and/or the instances of the arm 102 and/or the instances of the support 104. In one aspect, the user may orient and/or locate the instances of the arm 102 to imitate various strikes from an opponent.

For example, should the user wish to imitate a "cross" punch, the user may locate an instance of arm 102 approximately at a shoulder position relative to cushion 124 and/or the user, with a corresponding instance of support 104 aligned roughly parallel with the ground so the arm 102 may be motivated (e.g., pneumatically) directly at the user when standing at or over location 146. In one aspect, such a "cross" punch may be aimed toward the jaw of the user, or at another part of the user's body, where horizontal and/or vertical directioning of the particular support 104 may be employed to accomplish the imitation of the desired punch.

In a further example, an "upper-cut" punch may be imitated by lowering an instance of arm 102 and inclining the same toward an intended position of a portion of the user, when disposed about location 146. For instance, support 104 may be positioned below shoulder height, and the support 104 inclined upward to the user as viewed when standing at the location 146. Furthermore, the support 104 may be horizontally and/or vertically (e.g., obliquely) adjusted for the desired punching effect.

For instance, adjustment of arms 102 and/or cushion (e.g., torso) 124 may be effected by manual settings or by computer control. In one example, (e.g., computer) controller 110 may be coupled with a servo controlled solenoid type unit (not shown). Further, the solenoid type unit may be operated to adjust rotation of the arms about the vertical axis and/or the horizontal axis.

Any type of human strike may be imitated through adjustment and operation of physical interaction device 100. Other exemplary strikes include a "round-house" punch and/or a kick. Analogously to arms 102, the device may include one or more instance of a leg (not shown), such as for imitation of kicking.

Moreover, referring again to FIG. 1, controller 110 may be employed to preselect features such as frequency, timing, direction, duration, speed, force, and/or sequencing of a plurality of movements (e.g., strikes) by various instances of arm 102. In a further example, a number of such movement features for the arm 102 may result from a random selection, for instance, as directed by the controller 110 and/or by request of the user. As an exemplary user interface, in one example, the controller 110 may include a number of instances of switch (e.g., button) 148 and display 150. In one aspect, pedal 152 may be coupled with the controller 110 and adjustably located, for allowing the user and/or a supervisor to activate the pedal for (e.g., emergency) stoppage, such as for enhancing safe operation of physical interaction device 100.

A description of illustrative user operation of controller 110 is now presented with reference to FIG. 1, for explanatory purposes. In one embodiment, the controller 110 may include instances of switch 148 such as knobs or buttons 302, 304, 306, 308, 310, and/or 312, which may be operated in conjunction or cooperation with each other and/or visual prompts, readings, or cues provided to a user by display 150. In one example, the user may depress the button 302 a number of times in succession to indicate that a series of respective punches are to be thrown by a first instance of arm 102. Further, the user may depress the button 304 another number of times in succession in order to indicate that another series of respective punches are to be thrown by a second instance of the arm 102. Moreover, a sequence of user depressions or operations of the button 302 and the button 304 may serve to preselect ordering of punches from the first instance of the arm 102 as well as the second instance of the arm 102. For example, the user may depress the button 302 once, depress the button 304 once, depress the button 302 thrice more, and depress the button 304 twice more, to indicate that the first instance of the arm 102 will throw one punch followed by a second punch from the second instance of the arm, then followed by three punches from the first instance of the arm and lastly two punches from the second instance of the arm. In one aspect, the buttons 306 and 308 may allow user preselection of features such as speed and/or force of punches thrown by the first instance of the arm 102. Similarly, the buttons 3 10 and/or 312 may be employed by the user to, for example, preselect speed and/or force for certain punches thrown by the second instance of the arm 102. Numerous augmentations, variations, and/or modifications of such operation of physical interaction device 100 are possible, as will be appreciated by those skilled in the art.

In another aspect, still referring to FIG. 1, cushion 124 may be formed to resemble a torso and/or a head (e.g., of a human or humanoid). For instance, the cushion 124 may be formed to resemble the head and torso (e.g., integrally attached) for an attacker or opponent of a user who may occupy location 146. In one example, instances of arm 102 may be formed to cooperatively resemble human arms, wrists, hands, and/or fists, of such an attacker or opponent. So, various instances of the arm 102 and the cushion 124 may cooperate to realistically present a human opponent, visually as well as physically. Namely, the cushion 124 and the instances of the arm 102 may be formed with features akin to those of a human opponent, such as surfaces having suitable flexibility, texture, and/or resiliency. Further description of the arm 102 is presented herein.

Again referring to FIG. 1, a user disposed at location 146 may experience or participate in a training session with physical interaction device 100 which presents a superior or enhanced opportunity for refinement of skills (e.g., blocking techniques and/or footwork), such as may be employed in the martial arts. In one aspect, the user may operate controller 110 to preselect a number of strikes from instances of arm 102, with a design to test and/or practice specific sets of skills and/or abilities. In yet another aspect, a preselected duration and sequencing of strikes from the instances of the arm 102 may be employed for desired cardiovascular or stamina training. In a further aspect, the physical interaction device may be adjusted for features or attributes of a particular user. For instance, the height of the cushion 124 may be adjusted so the user may naturally throw punches and/or kicks toward the cushion 124, without instead, injuriously, or painfully hitting base 112. Furthermore, the instances of the arm 102 may be located vertically and adjusted horizontally and/or obliquely in order to suit physical characteristics of the user. In a still further aspect, frequency, timing, direction, duration, speed, force, and/or sequencing of a plurality of movements of the instances of the arm 102 may be suited for physical characteristics (e.g., age and/or physical conditioning) of the user. For example, one may select a lower force setting and a slower frequency of strikes from the instances of the arm 102 as the age and/or ability decreases from one particular user to the next user. Such adjustability, in a first aspect, may increase safety of use of the physical interaction device 100, and, in a second aspect, may allow users at different levels of ability to more quickly develop their skills by tailoring a training regimen to the individual.

In a further aspect, physical interaction device 100 may be scaled down in size, speed, and/or power, such as to accommodate youths and/or beginners.

Figure 2:
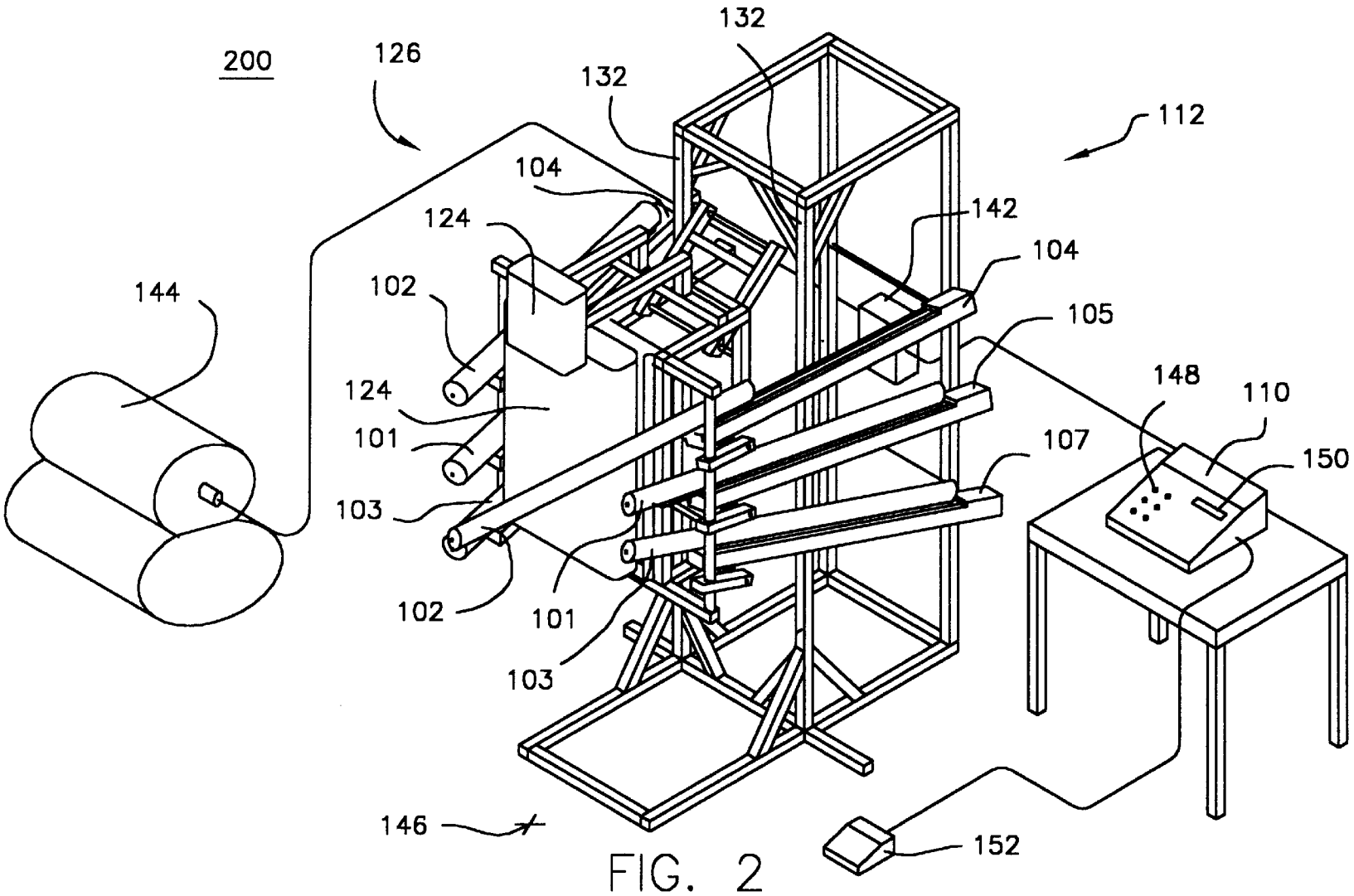
FIG. 2 is partial, perspective view of another example of a physical interaction device, illustrating another example of exemplary cooperative formation and location of flexible arms and cushions.

Turning to FIG. 2, physical interaction device 200 may include a plurality of instances of arm 102 disposed about (e.g., along transversely opposite sides of) one or more instances of cushion 124. In one aspect, the multiplied (e.g., relative to physical interaction device 100 of FIG. 1) instances of the arm 102 may advantageously allow sequencing of a variety of strikes from multiple side of the instances of the cushion 124, without stoppage to reposition one or more of the instances of the arm 102. So, the user may advantageously preselect to sequence through, for instance, a "left-cross" punch followed by a right "jab" punch and immediately followed thereafter by a left "upper-cut" punch, with any number and/or variety of alternative or additional strikes possible.

Figure 3:
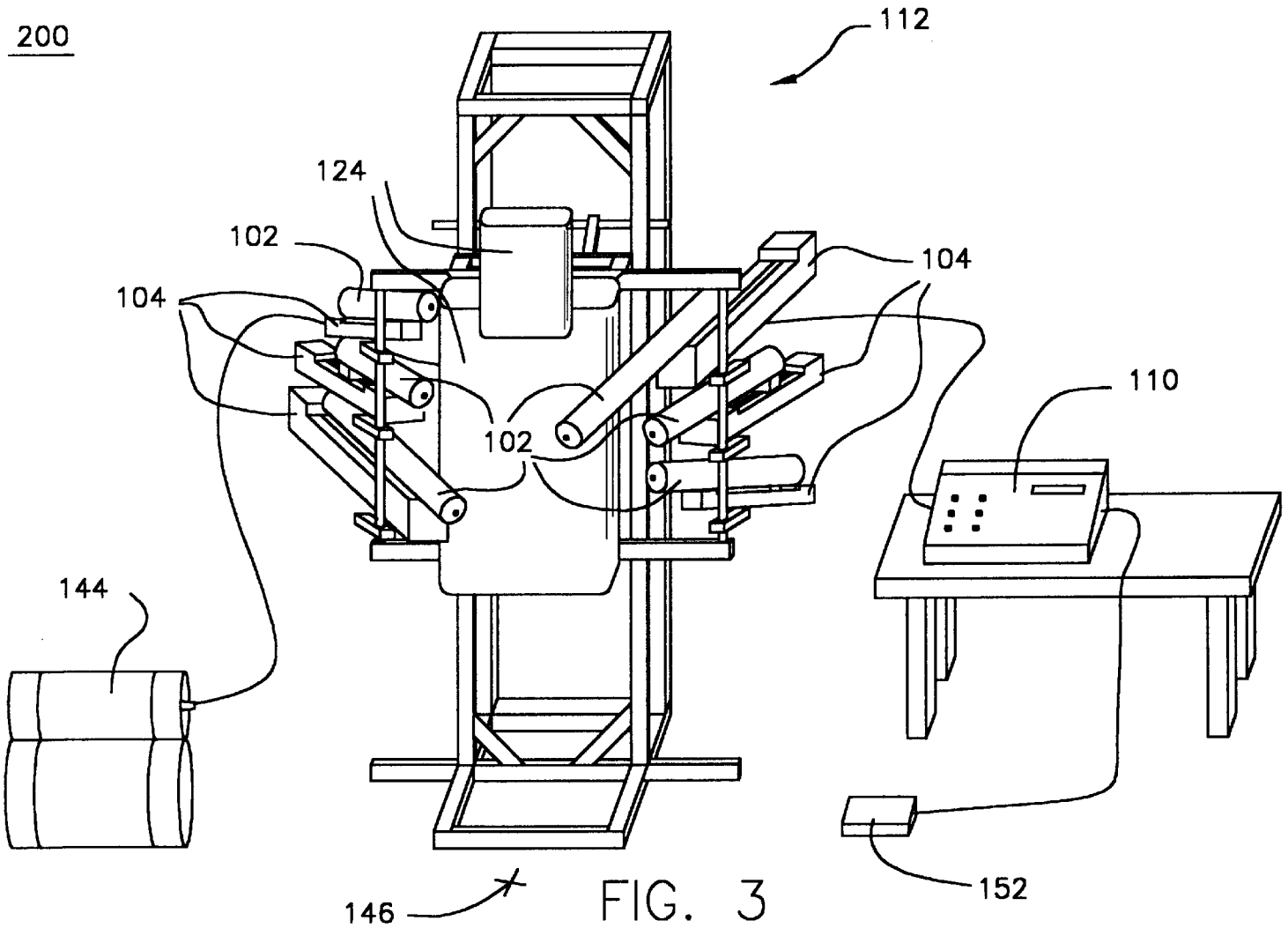
FIG. 3 is partial, front, elevation view of the physical interaction device of FIG. 2.

Now referring to FIGS. 1–3, in one aspect of the invention, various instances of arm 102 may have flexibility to imitate a human strike for interaction with the user. For instance, a user standing at location 146 may employ part of a limb (e.g., a forearm) to block and/or deflect a strike from a particular instance of the arm 102. That is, (e.g., martial arts) defensive maneuvers or tactics may be tested or practiced, such as by forcing imitated human strikes from the instances of the arm 102 to be blocked, deflected, or glanced away from, or diminished in impact to, targeted portions of the user's body through execution of a series of counteractive or checking blocks or parries. Furthermore, the arm 102 may be formed to imitate inertia, resistance, and/or re-directionability of a human strike. In yet another aspect, movement of the instances of the arm 102 may further imitate recoiling or retraction of a part of an opponent, such as a strike from a human arm followed by cocking of and re-striking by that human arm. Moreover, such movement may further enhance training or entertainment of the user such as by requiring attention to timing in order to execute defensive blocks of imitated human strikes before withdrawal or recoil of the arm 102, with an exemplary goal of achieving a sufficiently quick user reaction rate that the imitated human strikes may be blocked or deflected during extension of the arm 102 toward the user.

A number of exemplary augmentations and/or modifications of physical interaction device 100 are now presented. In one example, the device may include various modes, such as a random use mode and/or a training mode. For instance, the random use mode may provide a random punch and/or kick sequence. The training mode may employ a light (not shown) located next to a certain arm 102. The light may be activated just before a punch is thrown by the arm. Sensors (not shown) located on and/or connected to body 112 may determine how hard the device is hit by a user, such as for feedback and/or display to the user regarding strength of blows and/or blocks. A timer (not shown), the sensors, and/or the like may be employed in scoring hits (e.g., blocks and/or counterpunches) by the user against the device, and/or scoring strikes from the device to the user.

In one example, referring again to FIGS. 1–3, arm 102 may be formed with an inflatable, elastic material such as rubber. In another example, the arm 102 may be formed with a compliant yet formable material such as a synthetic foam.

Still referring to FIGS. 1–3, in a further aspect, one or more instances of cushion 124 may resemble a torso and/or head of a human. For example, a user disposed at location 146 may employ part of a limb (e.g., a forearm) to deliver a blow to a part of an instance of the cushion 124. In one example, a certain instance of the cushion may be formed with one or more resilient but cushioned materials such as those exemplarily listed above for illustrative discussion of arm 102. In addition, the cushion may comprise a casing formed with material such as canvas or leather. Furthermore, modification may be made to a physical interaction device to accommodate a disability of a user. Also, a physical interaction device may be customized for entertainment purposes.

As will be appreciated by those skilled in the art, any physical interaction device and/or component and/or capability thereof described herein, may include or omit any number of features of any other physical interaction device of the present invention.

While part(s) of the description herein, for explanatory purposes, may imply certain exemplary direction(s), such direction(s) may be considered relative. As will be appreciated by those skilled in the art, the significance of, for example, a "vertically upward" direction in many environments stems from its opposition to a dominant "downwardly" acting gravitational force, resulting,from the presence of a large mass such as the Earth, where "vertical" approximates radial alignment therewith. Furthermore a "horizontal" direction and a "vertically upward" direction can be readily ascertained following determination of an appropriate "downward" direction. Design choice(s) allow accommodation(s) of any orientation(s) for any device(s) in accordance with the principles of the present invention.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A physical interaction device, comprising:

a base;

an arm connected to said base at a support, said arm including an elongate flexible portion sized to physically interact with a limb portion of a user of said device, the position of said arm at said support being at least one of vertically, horizontally and obliquely adjustable relative to said base; and a controller linkable with said arm, said controller configured to selectively cause a longitudinal movement of said flexible portion, said movement serving to extend said flexible portion from said base and contact said flexible portion with said user to physically imitate a human strike toward said user.

2. The device of claim 1, wherein said flexible portion is formed to allow said user to employ said limb portion to execute at least one of a block and deflection of said movement.

3. The device of claim 1, wherein said controller is linked with said arm, and wherein said controller allows at least one of random selection and user preselection of at least one of frequency, timing, direction, duration, speed, force, and sequencing of a plurality of movements of said flexible portion.

4. The device of claim 1 further comprising a cushion connected with said base, said cushion formed to receive a physical strike from said user.

5. The device of claim 4, wherein said cushion is at least one of vertically and horizontally adjustably connected with said base.

6. The device of claim 4, wherein said cushion includes a region sized comparably to a torso, and wherein a location of said arm relative to said region serves to imitate a relation between a human arm and a torso corresponding thereto.

7. The device of claim 4, wherein a part of at least one of said arm and said cushion is formed to resemble a human physique portion.

8. The device of claim 1, wherein at least one of an electrical, hydraulic, pneumatic, and mechanical link allows said controller to be linked with said arm.

9. The device of claim 1, wherein said arm comprises a first arm, wherein said elongate flexible portion comprises a first flexible portion, wherein said longitudinal movement comprises a first movement, and further comprising a second arm, said second arm including a second flexible portion sized to physically interact with said user; and wherein said controller is linkable with said second arm, said controller configured to selectively cause a second movement of said second flexible portion, said second movement serving to extend said second flexible portion from said base and contact said second flexible portion with said user.

10. The device of claim 9, wherein a location of said first arm relative to said second arm serves to imitate a relation between a pair of human arms.

11. The device of claim 9, further comprising a third arm movably connected with said base, said third arm including a third flexible portion sized to physically interact with said user;

wherein said controller is linkable with said third arm, said controller configured to selectively cause a third movement of said third flexible portion; and wherein a relation between said first movement and said third movement serves to imitate strikes emanating from one side of a human, said strikes directed toward said user.

12. The device of claim 11, wherein said second movement serves to imitate a strike emanating from another side of said human.

13. A physical interaction device, comprising:

a base;

a first arm connected to said base at a first support, said first arm including a first flexible portion sized to physically interact with a first limb portion of a user of said device, the position of said arm being at least one of vertically, horizontally, and obliquely adjustable relative to said base;

a second arm movably connected with said base at a second support, said second arm including a second flexible portion sized to physically interact with at least one of said first limb portion and a second limb portion of said user; and a controller linkable with said first arm and said second arm, said controller configured to selectively cause a first movement of said first flexible portion, said controller configured to selectively cause a second movement of said second flexible portion, said first movement serving to contact said first flexible portion with said user to physically imitate a first human strike toward said user, said second movement serving to contact said second flexible portion with said user to physically imitate a second human strike toward said user.

14. The device of claim 13 further comprising a cushion connected with said base, said cushion located between said first arm and said second arm.

15. A physical interaction method, comprising:

locating an elongate flexible portion of an arm apart from a user, said arm connected with a base at a support, the position of said arm at said support being at least one of vertically, horizontally, and obliquely adjustable relative to said base, said flexible portion sized to physically interact with a limb portion of said user; and extending said flexible portion longitudinally from said base to contact said user and physically imitate a human strike toward said user.

16. The method of claim 15, further comprising retracting said flexible portion from said user to physically imitate a human recoil from said user.

17. The method of claim 15, wherein said elongate flexible portion comprises a first flexible portion, wherein said arm comprises a first arm, wherein said human strike comprises a first strike, and further comprising extending a second flexible portion of a second arm from said base to contact said user and physically imitate a second strike toward said user.

18. The method of claim 17, wherein a relation between said extending of said first flexible portion and said extending of said second flexible portion serves to imitate a relation between strikes emanating from a pair of human arms.

19. The method of claim 15, further comprising executing a plurality of movements of said flexible portion as directed by at least one of a random selection and a preselection of at least one of frequency, timing, direction, duration, speed, force, and sequencing of said plurality of movements.

* * * * *